US010577762B2

(12) United States Patent
Abu Al-Rubb

(10) Patent No.: US 10,577,762 B2
(45) Date of Patent: Mar. 3, 2020

(54) TRAFFIC CALMING DEVICE

(71) Applicant: Khalil Mahmoud Abu Al-Rubb, London (GB)

(72) Inventor: Khalil Mahmoud Abu Al-Rubb, London (GB)

( * ) Notice: Subject to any disclaimer, the term of this patent is extended or adjusted under 35 U.S.C. 154(b) by 0 days.

(21) Appl. No.: 15/744,596

(22) PCT Filed: Jul. 7, 2016

(86) PCT No.: PCT/EP2016/066153
§ 371 (c)(1),
(2) Date: Apr. 26, 2018

(87) PCT Pub. No.: WO2017/009180
PCT Pub. Date: Jan. 19, 2017

(65) Prior Publication Data

US 2018/0298570 A1 Oct. 18, 2018

(30) Foreign Application Priority Data

Jul. 13, 2015 (LU) ..... 92772

(51) Int. Cl.
*E01F 11/00* (2006.01)
*E01F 9/529* (2016.01)
*E01F 13/12* (2006.01)

(52) U.S. Cl.
CPC ..... *E01F 9/529* (2016.02); *E01F 13/126* (2013.01)

(58) Field of Classification Search
CPC ..... E01F 9/00; E01F 9/529
USPC ..... 404/11, 15
See application file for complete search history.

(56) References Cited

U.S. PATENT DOCUMENTS 1,660,559 A * 2/1928 Hodgkinson ..... E01F 9/529 116/DIG. 16
4,332,503 A * 6/1982 Hurst, Jr. ..... E01F 13/105 404/11
5,486,065 A * 1/1996 James ..... E01F 9/529 404/15
6,010,277 A * 1/2000 Follman ..... E01F 9/529 404/10
6,024,510 A * 2/2000 Kamienchick ..... E01F 9/529 404/15

(Continued)

FOREIGN PATENT DOCUMENTS

EP 2011923 A2 1/2009
WO WO-9419544 A1 * 9/1994 ..... E01F 9/529

(Continued)

OTHER PUBLICATIONS

European Patent Office, International Search Report in International Patent Application No. PCT/EP2016/066153, dated Sep. 13, 2016, 3 pp.

(Continued)

*Primary Examiner* — Thomas B Will
*Assistant Examiner* — Katherine J Chu
(74) *Attorney, Agent, or Firm* — Leydig, Voit & Mayer, Ltd.

(57) ABSTRACT

A traffic calming device comprising an obstacle which is placed on a road, the obstacle being moveable or deflateable at a predetermined speed or rate so that the obstacle presents a smaller profile to a vehicle driving at or below the speed limit.

17 Claims, 3 Drawing Sheets

(56) References Cited

U.S. PATENT DOCUMENTS

Figure 1A:
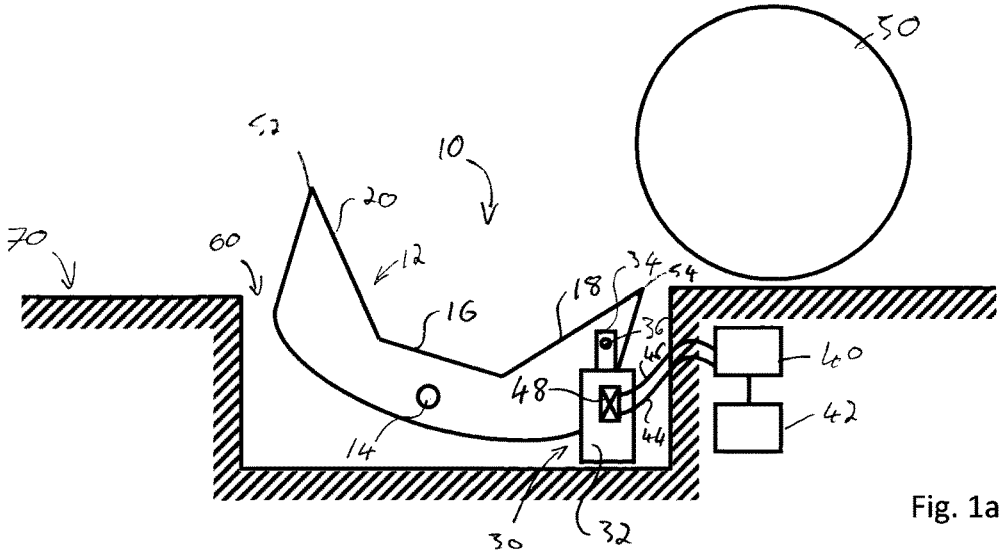

| | | | | |
|---|---|---|---|---|
| 6,659,682 | B2 * | 12/2003 | Heeks | E01F 9/529 404/15 |
| 6,726,399 | B2 * | 4/2004 | Heeks | F16K 17/048 404/15 |
| 6,877,929 | B1 * | 4/2005 | Yang | E01F 13/126 404/10 |
| 7,004,193 | B2 * | 2/2006 | Heeks | F16K 17/048 137/512.2 |
| 7,114,873 | B2 * | 10/2006 | Rastegar | E01F 13/123 404/6 |
| 8,979,419 | B2 * | 3/2015 | Heald | E01F 13/123 404/6 |
| 2014/0227031 | A1 * | 8/2014 | Fifi | E01F 9/529 404/15 |

FOREIGN PATENT DOCUMENTS

| | | | | |
|---|---|---|---|---|
| WO | WO 97/00181 | A2 | 1/1997 | |
| WO | WO 2009/123485 | A1 | 10/2009 | |
| WO | WO-2014165935 | A1 * | 10/2014 | E01F 9/529 |

OTHER PUBLICATIONS

European Patent Office, Written Opinion in International Patent Application No. PCT/EP2016/066153, dated Sep. 13, 2016, 6 pp.

* cited by examiner

TRAFFIC CALMING DEVICE

CROSS-REFERENCE TO RELATED APPLICATIONS

This application is a national phase application of International Patent Application No. PCT/EP2016/066153, filed Jul. 7, 2016, which claims priority from Luxembourg Patent Application No. 92772, filed Jul. 13, 2015, both of which are incorporated by reference herein in their entireties for all purposes.

TECHNICAL FIELD

Embodiments of the invention relate to a device for calming traffic.

BACKGROUND

Traffic calming devices such as speed bumps operate on the principle that an obstruction placed in the way of a vehicle will encourage drivers to slow down to avoid the unpleasant sensation of passing over the obstacle at speed, and the corresponding damage that this may cause to their vehicles.

However, speed bumps suffer from the disadvantage that the potential damage done to a vehicle will depend on the configuration of that vehicle. For example, sports cars which have a low clearance height might suffer damage not only to the suspension, but also to the body of the vehicle if the clearance height is not sufficient. In contradistinction, sport utility vehicles have high clearance heights and suspension designed to accommodate obstacles. Therefore, drivers of such vehicles have little or no incentive to slow down in the knowledge that the potential damage to their vehicles will be minimal.

Dynamic speed bumps which are raised and lowered on demand are known. However, these dynamic speed bumps operate by being attached to a speed sensor which determines the speed of the approaching vehicle and lowers the speed bump if the speed is less than the speed limit.

Such dynamic speed bumps suffer from the disadvantage that they are costly to produce and maintain, and require significant energy requirements to operate.

SUMMARY

According to a first aspect, the invention provides a traffic calming device comprising a moveable obstacle and a retraction mechanism for moving the obstacle when a vehicle is brought into contact with the obstacle, wherein the retraction mechanism comprises a release system for moving the obstacle at a predetermined speed.

The obstacle is a cradle for engaging with one or more wheels of a vehicle.

The obstacle may be retractable.

The obstacle may be deflateable and said movement of said obstacle at the predetermined speed may comprise deflating the obstacle.

The retraction mechanism may comprise a fluid release and my be an hydraulic piston.

The fluid release may further comprise a release valve.

A flow rate of the release valve may be adjustable.

The predetermined speed may be variable so that a user may set the predetermined speed in dependence on a speed limit. The predetermined speed may be set by adjusting a flow rate of the release valve.

The predetermined speed may be related to a fluid flow rate of said release valve.

The obstacle may comprise a cradle for engaging with one or more wheels of the car, wherein the cradle may be engaged with the retraction mechanism, the retraction mechanism may comprise an hydraulic cylinder, the cradle may be adapted for pivotal movement relative to a surface upon which the wheel proceeds, wherein the cradle may be engaged with the hydraulic cylinder so that the pivoting movement of the cradle commensurate with a forward direction of the vehicle compresses the hydraulic cylinder, the retraction mechanism may further comprise a release valve engaged with the hydraulic cylinder so that the hydraulic cylinder has a maximum rate of operation, and so that the pivoting movement of the cradle is limited by the maximum rate of operation of the hydraulic cylinder.

The cradle may comprise first and second arms.

The retraction mechanism may comprise a first and a second hydraulic cylinder, each hydraulic cylinder being connected to corresponding arms of the cradle so that pivoting of the cradle in a first direction engages the first hydraulic cylinder and pivoting of the cradle in a second direction engages the second hydraulic cylinder.

A further embodiment of the invention relates to a method for calming traffic comprising providing a moveable obstacle and moving the obstacle at a predetermined speed when a vehicle is brought into contact with the obstacle.

The obstacle may be a cradle for engaging with one or more wheels of a vehicle.

The obstacle may be retractable.

The obstacle may be deflateable and said step of moving of said obstacle at the predetermined speed may comprise deflating the obstacle.

The obstacle may be moved by a fluid release.

The obstacle may be moved by an hydraulic piston.

The method may further comprise providing a release valve.

A flow rate of the release valve may be adjustable.

The predetermined speed may be variable so that a user may set the predetermined speed in dependence on a speed limit.

The predetermined speed may be related to a fluid flow rate of said release valve.

The method may comprise the further step of reversing a movement of the obstacle once the vehicle is out of contact with the obstacle.

The obstacle may be moved back to an initial position.

The obstacle may be moved back to position which varies from an initial position.

DESCRIPTION OF ACCOMPANYING FIGURES

Figure 1B:
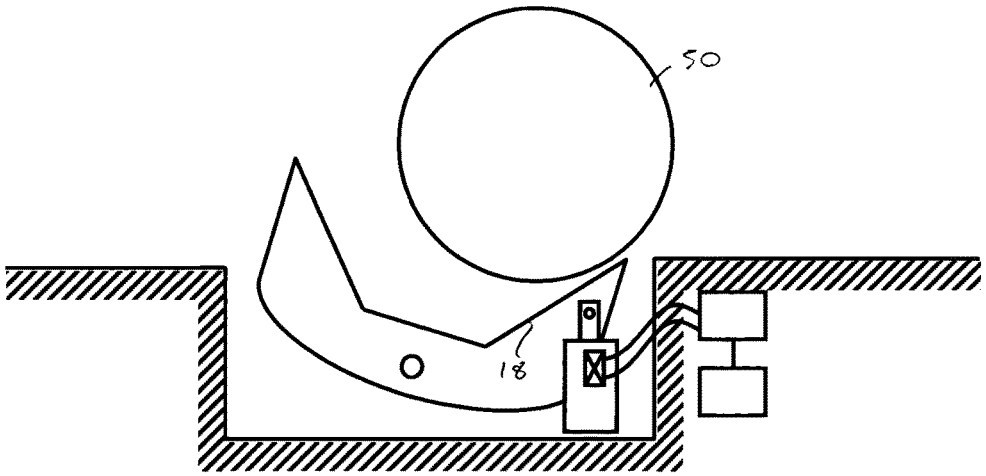
Figure 1C:
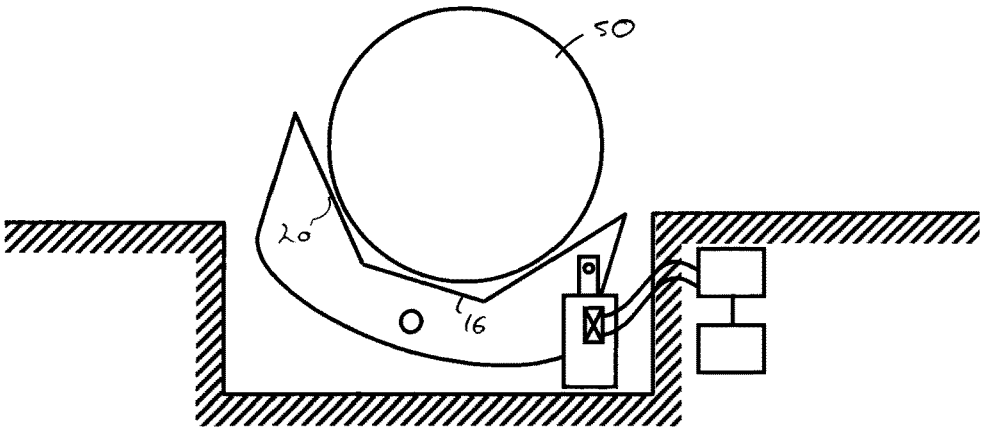
Figure 1D:
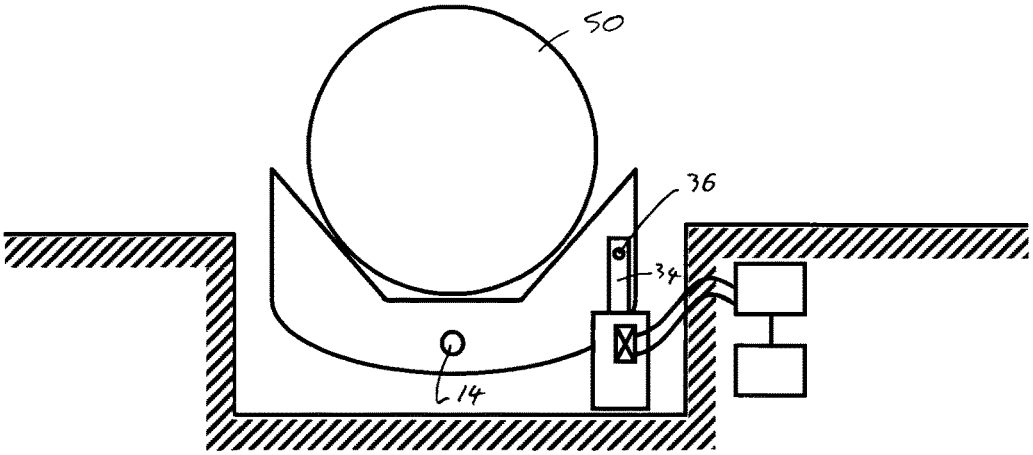
Figure 1E:
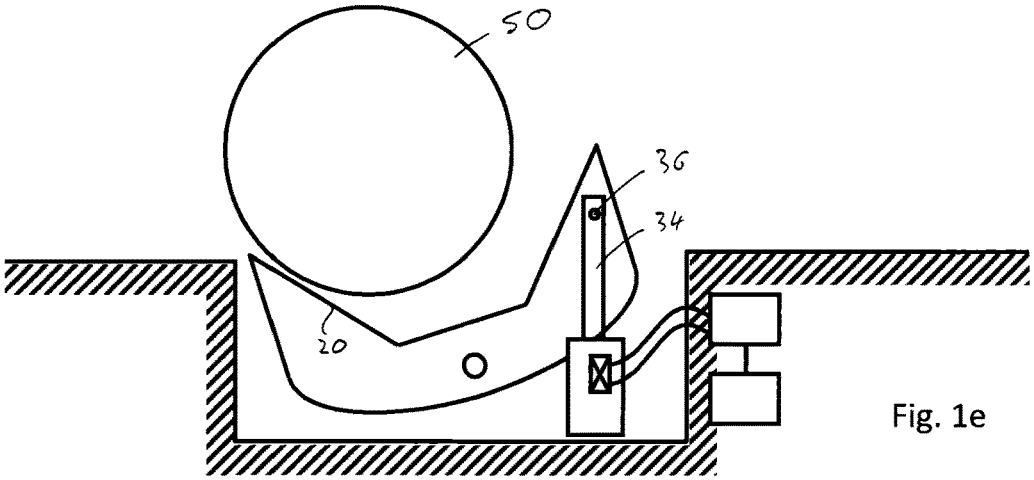
Figure 1F:
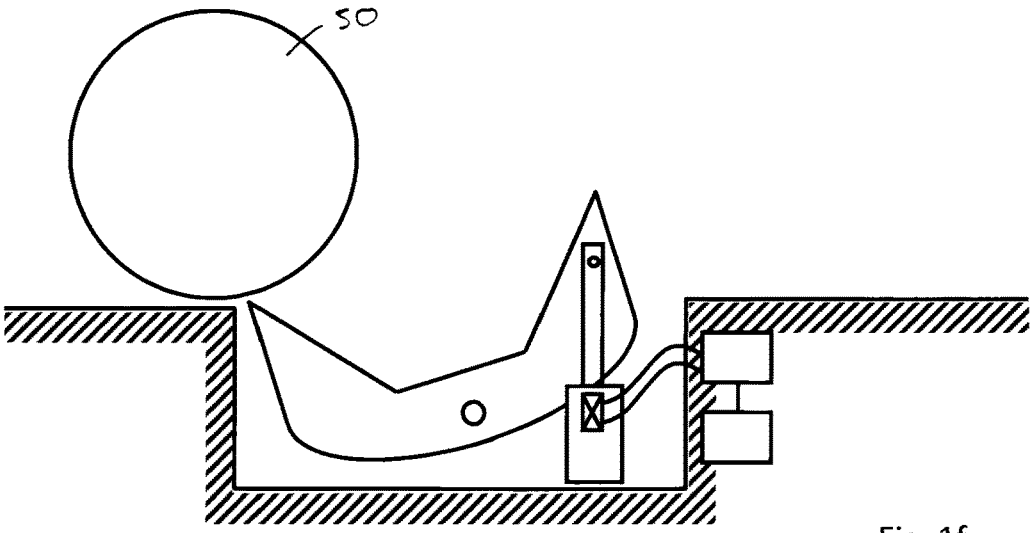
Figure 2:
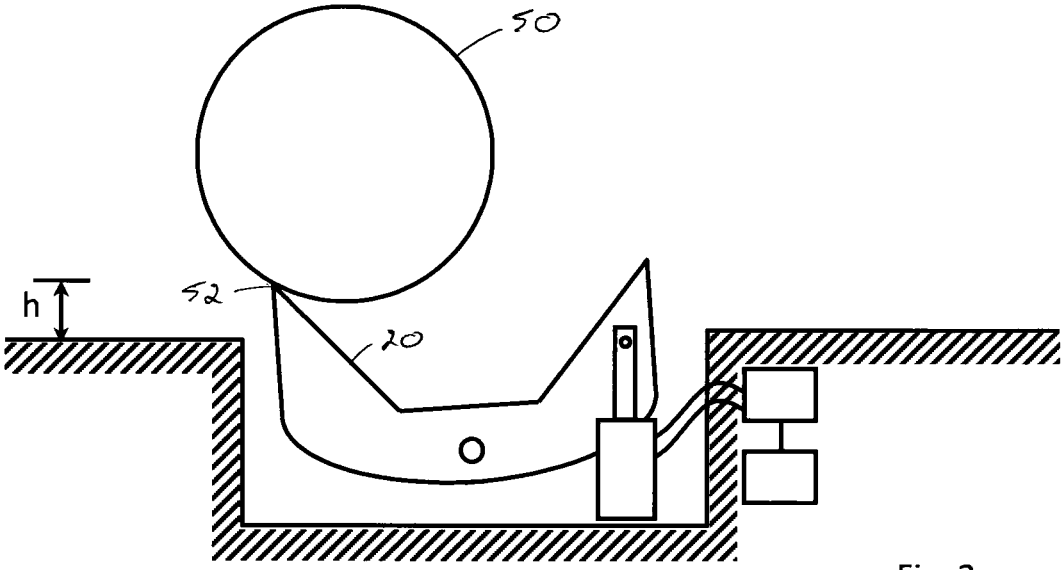
Figure 3:
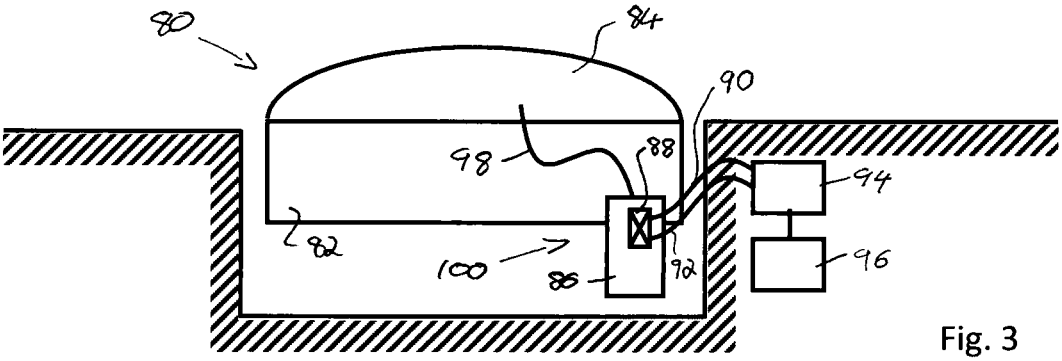

Embodiments of the invention are described with reference to the accompanying schematic diagrams where:

FIGS. 1*a* to 1*f* are schematic diagrams of a traffic calming device according to a first embodiment under different configurations when a vehicle approaches at or below the speed limit;

FIG. 2 is a schematic diagram of the traffic calming device of FIG. 1 when a vehicle approaches at a speed in excess of the speed limit; and FIG. 3 is a schematic diagram of a traffic calming device according to a further embodiment of the invention.

DESCRIPTION OF EMBODIMENTS

Embodiments of the invention are described hereafter with reference to the accompanying diagrams.

FIG. 1 illustrates a traffic calming device 10 according to an embodiment of the invention. The traffic calming device 10 comprises a cradle 12 mounted so that it can pivot about axel 14. The cradle 10 is mounted in a depression 60 formed in a road surface 70. In an alternate embodiment, the cradle is provided on top of the road surface.

The cradle 12 comprises two arms 52 and 54 which are formed with corresponding inner surfaces 20 and 18. Inner surfaces 20 and 18 are joined by middle surface 16.

A retraction mechanism 30 is attached to arm 54. The retraction mechanism 30 comprises an hydraulic cylinder 32 having an extendible shaft 34. The extendible shaft 34 is attached to the arm 54 at a pivot joint 36.

The retraction mechanism 30 of the traffic calming device 10 further comprises a pump 42 and a reservoir of hydraulic fluid 40. The reservoir 40 is connected to the hydraulic cylinder 32 by means of a supply line 46 and a return line 44. The retraction mechanism 30 further comprises a release valve 48 which, in this embodiment, is incorporated into the hydraulic cylinder and which allows fluid to flow from the hydraulic cylinder back through the return line 44 to the fluid reservoir 40. Therefore, the retraction mechanism is arranged so that the downward (in the orientation shown in the Figures) movement of the shaft 34 is limited by the rate at which fluid is released by the release valve 48.

It is to be realised that the location and configuration of the hydraulic cylinder and pump may be varied in further embodiments and the particular arrangement illustrated is provided by way of illustration only.

In the embodiment illustrated, the cradle 12 is moveable in that it can pivot about the axel 14. This pivoting movement causes the extension and retraction of the shaft 34 of the retraction mechanism 30. It is to be realised that some lateral movement of the pivot joint 36 between the shaft 34 and the arm 54 of the cradle 12 will occur. Although not illustrated in this schematic diagram, such lateral movement is accommodated by the pivot joint 36.

In use, the pump 42 controls the flow of hydraulic fluid between the reservoir and the hydraulic cylinder 32 through the supply line 46 and the return line 44. In the embodiment illustrated, the pump 42 is therefore able to pivot the cradle. However, in normal operation, the pump 42 acts to pivot the cradle 12 so that arm 54 is lowered, and arm 52 is raised. Pivoting of the cradle 12 in the opposite direction will occur under the influence of a vehicle, as described below.

Also illustrated in FIG. 1*a* is the wheel 50 of a vehicle. In FIGS. 1*a* to 1*f* the vehicle is travelling from right to left, and the operation of the traffic calming device 10 will be described with reference to these Figures.

FIG. 1*a* shows the traffic calming device 10 in an operationally ready state. In this state, the cradle 12 has been pivoted so that the arm facing the oncoming wheel 50 is lowered, thereby raising the opposite arm. As illustrated in FIG. 1*b*, the wheel 10 then engages the traffic calming device by engaging with the surface 18 of arm 54 of cradle 12. As the wheel 50 progresses, it then comes into contact with the middle surface 16 and the surface 20 of arm 52. In the embodiment illustrated, the size of the cradle 12 and of the wheel 50 are such that the wheel engages with these three surfaces (18, 16 and 20) simultaneously. However, it is to be realised that wheel sizes will vary substantially from vehicle to vehicle and for other wheel sizes, fewer of the surfaces of the cradle will be engaged. Furthermore, the cradle need not have the profile illustrated.

In further embodiments, the cradle is provided with a profile adapted to the required design criteria. For example, the height of the profile may be designed relative to the speed limit of the location where the cradle is to be installed.

Advantageously, the profile presented to a vehicle travelling in the wrong direction will be greater than that presented to a vehicle travelling against the intended direction. This will discourage drivers from trying to circumvent the traffic calming device by veering onto the oncoming traffic lane.

As the wheel 50 progresses it pushes against the surface 20, this causes the cradle to pivot about axel 14, bringing arm 52 downwards and arm 54 upwards so that the cradle 12 moves to the orientation shown in FIG. 1*d*, and then continues moving until the cradle has pivoted to the furthest extent permitted, shown in FIG. 1*e*, at which point, the wheel 50 will continue to move and will exit the traffic calming device 10, as shown in FIG. 1*f*.

As shown in FIGS. 1*d*, 1*e* and 1*f*, as the cradle 12 pivots, the shaft 34 extends as the cradle 12 pivots under the influence of wheel 50. The shaft 34 is not freely moveable, but the rate of the upward movement is controlled by rate at which the release valve 48 allows fluid to pass there through. So too, the rate at which the cradle 12 pivots is controlled by the release valve 48.

The rate at which the release valve 48 releases the fluid is set, taking into account the dimensions and other properties of the cradle 12 so that the maximum rate at which the cradle can pivot between the configurations shown in FIG. 1*a* and that shown in FIG. 1*f* corresponds to the vehicle travelling at the speed limit.

If the wheel 50 of the vehicle engages with the cradle 12 when the vehicle is travelling at a speed which is greater than the speed limit, the result is shown in FIG. 2. Since the cradle 12 has not completed its pivoting movement at the time the wheel 50 exits the traffic calming device (as shown in FIG. 2), the arm 52 is still raised relative to the surface of the road by the relative height 'h', thereby presenting the wheel with a significant obstacle to overcome, hence passing a bump (shock) to the vehicle and its driver proportional to the speed of the vehicle. Depending on the relative sizes of the cradle and the wheel and a number of other factors including application (contact) area which may be taken into account when constructing the cradle, and configuring the traffic calming device 10, the arm 52 may cause significant damage to the wheel 50 including a flat tire, wheel damage and/or damage to the suspension of the vehicle.

Therefore, embodiments of the invention provide a cheap and easy to configure device which presents the drivers of vehicles with significant incentive to stick to the speed limit. Furthermore, since the cradle can be installed with little or no raised profile relative to the road surface, any vehicle with low road clearance will not be adversely affected in negotiating this traffic calming device, provided of course that the speed limit is adhered to.

Once the wheel 50 has passed over the cradle, the pump 42 is operated to pump fluid from the hydraulic reservoir 40 to hydraulic cylinder 32, thereby raising the shaft 34, causing the cradle 12 to pivot back to the orientation shown in FIG. 1*a*. Alternatively, the cradle may not be returned all the way back to this position, but instead to an intermediate position such as the position illustrated in FIG. 1*d*, depending on factors such as the location, traffic flow, road authority pre-settings etc. to achieve the desired end result The embodiment illustrated in FIGS. 1 and 2 comprises a single hydraulic cylinder. However, in further embodiments two hydraulic cylinders attached to respective arms of the cradle are provided.

FIG. 3 illustrates a traffic calming device 80 according to a further embodiment. The traffic calming device 80 comprises a base 82 onto which a cushion 84 is mounted. In the embodiment illustrated, the cushion comprises a single bladder, but multiple bladders could also be used. Multiple bladders have the advantage of increasing the amplitude of the shock delivered to the vehicle.

The device 80 comprises a retraction mechanism which has a hydraulic cylinder 86 connected by a supply line 90 and a release line 92 to a hydraulic fluid reservoir 94. The hydraulic cylinder 86 is connected by a line 98 to the cushion 84. The hydraulic cylinder 86 comprises a release valve 88 which limits the rate at which fluid may pass through the cylinder 86.

During operation, the pump 96 pumps fluid from the hydraulic reservoir 94 through the supply line 92 to the hydraulic cylinder 86 thereby inflating the cushion 84. When the wheel of a vehicle engages with the cushion, the cushion will deflate by allowing fluid through the release valve 88 of hydraulic cylinder 86. Therefore, the obstacle presented to the vehicle can be reduced for those vehicles travelling at or below the speed limit.

The cushion 84 illustrated in FIG. 3 has a symmetrical profile. In further embodiments, the cushion is provided with an asymmetrical profile so that, as the cushion deflates under the weight of the vehicle, the obstacle presented to the wheel of the vehicle has a constant height, provided that the vehicle is travelling close to the speed limit.

In a further embodiment, the cradle is pivoted by a spring and motor acting against the spring.

The retraction mechanism may be triggered by a sensor which could be piezoelectric. An electrically actuated flow valve may be used to time the retraction mechanism.

Advantageously, embodiments of the invention do not require vehicles which are travelling at or below the predetermined speed to slow down and speed up, as in the case with existing speed bumps. This reduces the environmental impact of these traffic calming devices. It is to be realised too that the embodiments of the invention can adapted to high speed roads such as highways and apply to all vehicle types.

The invention claimed is:

1. A traffic calming device comprising a moveable obstacle and a retraction mechanism for moving the obstacle when a vehicle is brought into contact with the obstacle, wherein the retraction mechanism comprises a release system for moving the obstacle at a predetermined speed, wherein the predetermined speed is variable so that a user may set the predetermined speed in dependence on a speed limit, wherein the obstacle comprises a cradle for engaging with one or more wheels of the vehicle, wherein the cradle is engaged with the retraction mechanism, the retraction mechanism comprising at least one hydraulic cylinder, the cradle being adapted for pivotal movement relative to a surface upon which the wheel proceeds, wherein the cradle is engaged with the at least one hydraulic cylinder so that the pivoting movement of the cradle commensurate with the forward direction of the vehicle compresses the at least one hydraulic cylinder, the release system further comprising a release valve engaged with the at least one hydraulic cylinder so that the at least one hydraulic cylinder has a maximum rate of operation, and so that the pivoting movement of the cradle is limited by the maximum rate of operation of the at least one hydraulic cylinder and wherein the cradle includes first and second arms with a flat middle surface between the first and second arms.

2. The traffic calming device according to claim 1 wherein the obstacle is retractable.

3. The traffic calming device according to claim 1 wherein the retraction mechanism comprises a first and a second hydraulic cylinder, each hydraulic cylinder being connected to corresponding arms of the cradle so that pivoting of the cradle in a first direction engages the first hydraulic cylinder and pivoting of the cradle in a second direction engages the second hydraulic cylinder.

4. The traffic calming device according to claim 1 wherein the retraction mechanism comprises a fluid release.

5. The traffic calming device of claim 4 wherein the fluid release comprises an hydraulic piston.

6. The traffic calming device of claim 5 wherein the fluid release further comprises a release valve.

7. The traffic calming device according to claim 6 wherein a flow rate of the release valve is adjustable.

8. The traffic calming device according to claim 7, wherein the predetermined speed is related to a fluid flow rate of said release valve.

9. A method for calming traffic including calming movement of a vehicle having wheels proceeding on a surface, the method comprising:

providing a moveable obstacle, the moveable obstacle being movable at a predetermined speed when the vehicle is brought into contact with the movable obstacle, the movable obstacle including a cradle having first and second arms with a flat middle surface between the first and second arms, the cradle being pivotably mounted relative to the surface, the cradle being adapted to engage with at least one wheel of the vehicle, providing a retraction mechanism comprising at least one hydraulic cylinder for moving the obstacle when the vehicle is brought into contact with the obstacle, wherein the cradle is engaged with the at least one hydraulic cylinder so that a pivoting movement of the cradle commensurate with a forward movement of the vehicle compresses the hydraulic cylinder, providing a release system including a release valve engaged with the hydraulic cylinder so that the at least one hydraulic cylinder has a maximum rate of operation, and so that the pivoting movement of the cradle is limited by the maximum rate of operation of the hydraulic cylinder, setting a rate at which the release system will operate to set the predetermined speed, the predetermined speed being based upon a speed limit, and moving the obstacle at the predetermined speed when the vehicle is brought into contact with the obstacle.

10. The method according to claim 9 wherein the obstacle is retractable.

11. The method of claim 9 wherein the obstacle is moved by a fluid release.

12. The method of claim 11 wherein the obstacle is moved by a hydraulic piston.

13. The method according to claim 12 wherein a flow rate of the release valve is adjustable.

14. The method according to claim 13 wherein the predetermined speed is related to a fluid flow rate of said release valve.

15. The method according to claim 9 comprising the further step of reversing a movement of the obstacle once the vehicle is out of contact with the obstacle.

16. The method according to claim 15 wherein the obstacle is moved back to an initial position.

17. The method according to claim 15 wherein the obstacle is moved back to a position varies from an initial position.

* * * * *